US006695012B1

(12) United States Patent
Ring et al.

(10) Patent No.: US 6,695,012 B1
(45) Date of Patent: Feb. 24, 2004

(54) LUBRICANT COATING FOR EXPANDABLE TUBULAR MEMBERS

(75) Inventors: Lev Ring, Houston, TX (US); Andrei Gregory Filippov, Katy, TX (US); Mike Cowan, Sugar Land, TX (US); Bill Dean, Katy, TX (US)

(73) Assignee: Shell Oil Company, Houston, TX (US)

( * ) Notice: Subject to any disclaimer, the term of this patent is extended or adjusted under 35 U.S.C. 154(b) by 0 days.

(21) Appl. No.: 10/089,419

(22) PCT Filed: Oct. 5, 2000

(86) PCT No.: PCT/US00/27645

§ 371 (c)(1),
(2), (4) Date: Sep. 19, 2002

(87) PCT Pub. No.: WO01/26860

PCT Pub. Date: Apr. 19, 2001

Related U.S. Application Data

(60) Provisional application No. 60/165,228, filed on Nov. 12, 1999, and provisional application No. 60/159,039, filed on Oct. 12, 1999.

(51) Int. Cl.[7] ..... F16L 55/16

(52) U.S. Cl. ..... 138/98; 138/97; 138/137; 138/141

(58) Field of Search ..... 138/141, 137, 138/140, 98, 97, DIG. 6

(56) References Cited

U.S. PATENT DOCUMENTS 3,704,730 A * 12/1972 Witzig ..... 138/144
4,069,573 A * 1/1978 Rogers et al. ..... 29/890.031
4,413,395 A * 11/1983 Garnier ..... 29/890.044
4,573,248 A * 3/1986 Hackett ..... 29/423
5,330,850 A * 7/1994 Suzuki et al. ..... 428/623
5,368,075 A * 11/1994 Baro et al. ..... 138/98
5,678,609 A * 10/1997 Washburn ..... 138/107
5,689,871 A 11/1997 Carstensen
5,775,422 A 7/1998 Wong et al.
5,845,945 A 12/1998 Carstensen
6,015,012 A 1/2000 Reddick
6,131,265 A 10/2000 Bird
6,322,109 B1 11/2001 Campbell et al.
6,345,431 B1 2/2002 Greig
6,409,175 B1 6/2002 Evans et al.
6,419,147 B1 7/2002 Daniel
6,425,444 B1 7/2002 Metcalfe et al.
6,470,966 B2 10/2002 Cook et al.
6,497,289 B1 12/2002 Cook et al.
6,517,126 B1 2/2003 Peterson et al.
6,527,049 B2 3/2003 Metcalfe et al.
6,543,552 B1 4/2003 Metcalfe et al.
6,550,821 B2 4/2003 DeLange et al.
6,557,640 B1 5/2003 Cook et al.
6,561,227 B2 5/2003 Cook et al.
6,564,875 B1 5/2003 Bullock
6,568,471 B1 5/2003 Cook et al.
6,575,240 B1 6/2003 Cook et al.
6,578,630 B2 6/2003 Simpson et al.
6,585,053 B2 7/2003 Coon
6,604,763 B1 8/2003 Cook et al.

* cited by examiner

*Primary Examiner*—Patrick Brinson
(74) *Attorney, Agent, or Firm*—Haynes and Boone LLP; Todd Mattingly

(57) ABSTRACT

A lubricant coating (240) for expandable tubulars (215). The interior surfaces of the expandable tubulars are coated with the lubricant coating (240). The expandable tubulars (215) are then placed within a preexisting structure (205). The expandable tubulars are then radially expanded into contact with the preexisting structure.

174 Claims, 4 Drawing Sheets

LUBRICANT COATING FOR EXPANDABLE TUBULAR MEMBERS

CROSS REFERENCE TO RELATED APPLICATIONS

This application claims the benefit of the filing date of: (1) U.S. Provisional Patent Application serial No. 60/159,039, filed on Oct. 12, 1999; and (2) U.S. Provisional Patent Application serial No. 60/165,228, filed on Nov. 12, 1999, the disclosures of which are incorporated herein by reference.

This application is related to the following co-pending applications:

| Provisional patent application Ser. No. | Attorney Docket No. | Filing Date |
|---|---|---|
| 60/108,558 | 25791.9 | Nov. 16, 1998 |
| 60/111,293 | 25791.3 | Dec. 7, 1998 |
| 60/119,611 | 25791.8 | Feb. 11, 1999 |
| 60/121,702 | 25791.7 | Feb. 25, 1999 |
| 60/121,841 | 25791.12 | Feb. 26, 1999 |
| 60/121,907 | 25791.16 | Feb. 26, 1999 |
| 60/124,042 | 25791.11 | Mar. 11, 1999 |
| 60/131,106 | 25791.23 | Apr. 26, 1999 |
| 60/137,998 | 25791.17 | June 7, 1999 |
| 60/143,039 | 25791.26 | Jul. 9, 1999 |
| 60/146,203 | 25791.25 | Jul. 29, 1999 |
| 60/154,047 | 25791.29 | Sept. 16, 1999 |
| 60/159,082 | 25791.34 | Oct. 12, 1999 |
| 60/159,039 | 25791.36 | Oct. 12, 1999 |
| 60/159,033 | 25791.37 | Oct. 12, 1999 |
| 60/162,671 | 25791.27 | Nov. 01, 1999 |

Applicants incorporate by reference the disclosures of these applications.

BACKGROUND OF THE INVENTION

This invention relates generally to wellbore casings, and in particular to wellbore casings that are formed using expandable tubing.

Conventionally, when a wellbore is created, a number of casings are installed in the borehole to prevent collapse of the borehole wall and to prevent undesired outflow of drilling fluid into the formation or inflow of fluid from the formation into the borehole. The borehole is drilled in intervals whereby a casing which is to be installed in a lower borehole interval is lowered through a previously installed casing of an upper borehole interval. As a consequence of this procedure the casing of the lower interval is of smaller diameter than the casing of the upper interval. Thus, the casings are in a nested arrangement with casing diameters decreasing in downward direction. Cement annuli are provided between the outer surfaces of the casings and the borehole wall to seal the casings from the borehole wall. As a consequence of this nested arrangement a relatively large borehole diameter is required at the upper part of the wellbore. Such a large borehole diameter involves increased costs due to heavy casing handling equipment, large drill bits and increased volumes of drilling fluid and drill cuttings. Moreover, increased drilling rig time is involved due to required cement pumping, cement hardening, required equipment changes due to large variations in hole diameters drilled in the course of the well, and the large volume of cuttings drilled and removed.

The present invention is directed to overcoming one or more of the limitations of the existing procedures for forming wellbores.

SUMMARY OF THE INVENTION

According to one aspect of the present invention, an expandable tubular assembly is provided that includes one or more tubular members and a layer of a lubricant coupled to the interior surfaces of the tubular members.

According to another aspect of the present invention, a method of coupling an expandable tubular assembly including one or more tubular members to a preexisting structure is provided that includes coating the interior surfaces of the tubular members with a lubricant, positioning the tubular members within a preexisting structure and radially expanding the tubular members into contact with the preexisting structure.

According to another aspect of the present invention, an apparatus is provided that includes a preexisting structure and one or more tubular members coupled to the preexisting structure. The tubular members are coupled to the preexisting structure by the process of: coating the interior surfaces of the tubular members with a lubricant, positioning the tubular members within a preexisting structure, and radially expanding the tubular members into contact with the preexisting structure.

According to another aspect of the present invention, an expandable tubular assembly is provided that includes one or more tubular members, and a layer of a first part of a lubricant coupled to the interior surfaces of the tubular members.

According to another aspect of the present invention, a method of coupling an expandable tubular assembly including one or more tubular members to a preexisting structure is provided that includes positioning the expandable tubular assembly into the preexisting structure, injecting a quantity of a lubricant material into contact with the expandable tubular assembly, and radially expanding the expandable tubular assembly into contact with the preexisting structure.

According to another aspect of the present invention, an apparatus is provided that includes a preexisting structure and one or more tubular members coupled to the preexisting structure. The tubular members are coupled to the preexisting structure by the process of: positioning the tubular members into the preexisting structure, injecting a quantity of a lubricant material into contact with the tubular members, and radially expanding the tubular members into contact with the preexisting structure.

According to another aspect of the present invention, a method of coupling an expandable tubular assembly including one or more tubular members to a preexisting structure is provided that includes coating the interior surfaces of the tubular members with a first part of a lubricant, positioning the tubular members within a preexisting structure, circulating a fluidic material including a second part of the lubricant into contact with the coating of the first part of the lubricant, and radially expanding the tubular members into contact with the preexisting structure.

According to another aspect of the present invention, an apparatus is provided that includes a preexisting structure and one or more tubular members coupled to the preexisting structure. The tubular members are coupled to the preexisting structure by the process of: coating the interior surfaces of the tubular members with a first part of a lubricant, positioning the tubular members within a preexisting structure, circulating a fluidic materials having a second part of the lubricant into contact with the coating of the first part of the lubricant, and radially expanding the tubular members into contact with the preexisting structure.

DETAILED DESCRIPTION

A method and apparatus for coupling tubular members to a preexisting structure is provided. The internal surfaces of the tubular members are coated with a lubricant. The tubular members are then radially expanded into contact with a preexisting structure. In several alternative embodiments, the method and apparatus are used to form and/or repair a wellbore casing, a pipeline, or a structural support.

Figure 1:
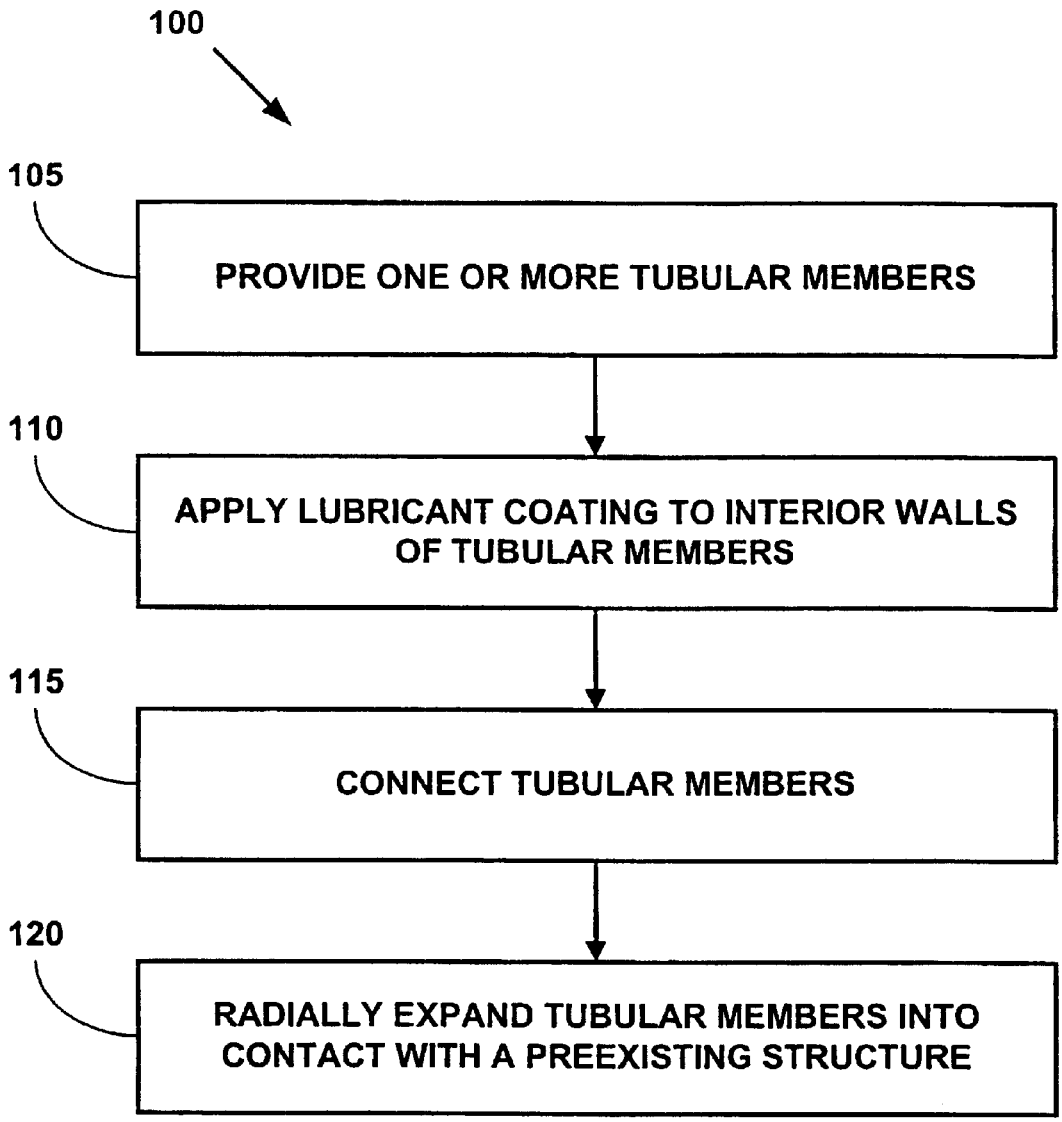
FIG. 1 is a flow chart illustrating a preferred embodiment of a method for coupling a plurality of tubular members to a preexisting structure.

In FIG. 1, a preferred embodiment of a method 100 for forming and/or repairing a wellbore casing, pipeline, or structural support includes the steps of: (1) providing one or more tubular members in step 105; (2) applying a lubricant coating to the interior walls of the tubular members in step 110; (3) coupling the first and second tubular members in step 115; and (4) radially expanding the tubular members into contact with the preexisting structure in step 120.

Figure 2:
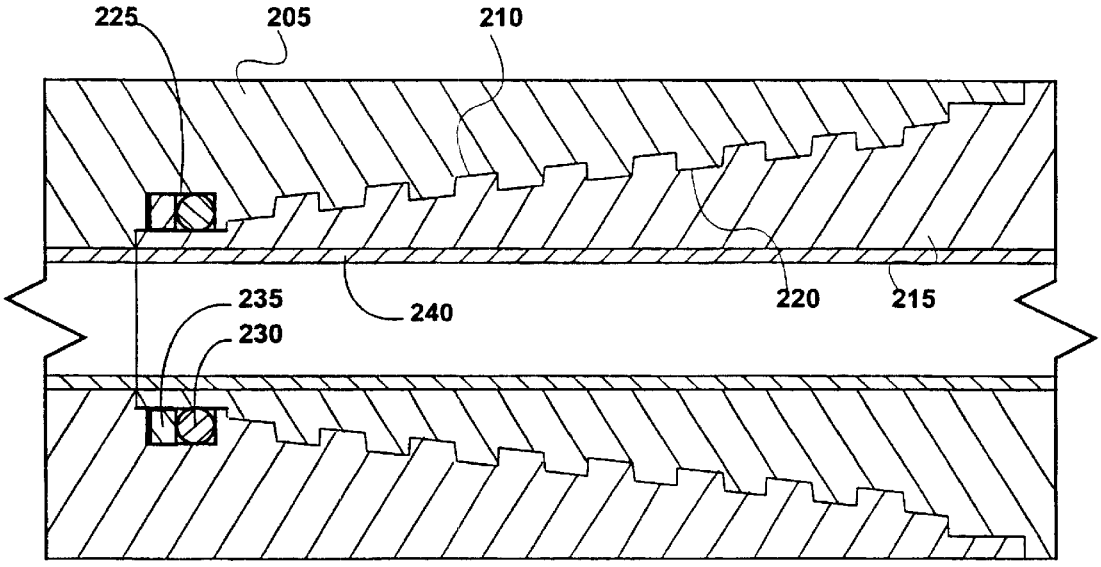
FIG. 2 is cross sectional illustration of a plurality of tubular members including in internal coating of a lubricant.

As illustrated in FIG. 2, in a preferred embodiment, in step 105, a first tubular member 205 having a first threaded portion 210 and a second tubular member 215 having a second threaded portion 220 are provided. The first and second tubular members, 205 and 215, may be any number of conventional commercially available tubular members. In a preferred embodiment, the first tubular member 205 includes a recess 225 containing a sealing member 230 and a retaining ring 235. In a preferred embodiment, the first and second tubular members, 205 and 210, are further provided substantially as disclosed in one or more of the following co-pending applications:

| Provisional patent application Ser. No. | Attorney Docket No. | Filing Date |
|---|---|---|
| 60/108,558 | 25791.9 | Nov. 16, 1998 |
| 60/111,293 | 25791.3 | Dec. 7, 1998 |
| 60/119,611 | 25791.8 | Feb. 11, 1999 |
| 60/121,702 | 25791.7 | Feb. 25, 1999 |
| 60/121,841 | 25791.12 | Feb. 26, 1999 |
| 60/121,907 | 25791.16 | Feb. 26, 1999 |
| 60/124,042 | 25791.11 | Mar. 11, 1999 |
| 60/131,106 | 25791.23 | Apr. 26, 1999 |
| 60/137,998 | 25791.17 | June 7, 1999 |
| 60/143,039 | 25791.26 | Jul. 9, 1999 |
| 60/146,203 | 25791.25 | Jul. 29, 1999 |
| 60/154,047 | 25791.29 | Sept. 16, 1999 |
| 60/159,082 | 25791.34 | Oct. 12, 1999 |
| 60/159,039 | 25791.36 | Oct. 12, 1999 |
| 60/159,033 | 25791.37 | Oct. 12, 1999 |
| 60/162,671 | 25791.27 | Nov. 01, 1999 |

Applicants incorporate by reference the disclosures of these applications.

In a preferred embodiment, in step 110, a coating 240 of a lubricant is applied to the interior surfaces of the first and second tubular members, 205 and 215. The coating 240 of lubricant may be applied prior to, or after, the first and second tubular members, 205 and 215, are coupled. The coating 240 of lubricant may be applied using any number of conventional methods such as, for example, dipping, spraying, sputter coating or electrostatic deposition. In a preferred embodiment, the coating 240 of lubricant is chemically, mechanically, and/or adhesively bonded to the interior surfaces of the first and second tubular members, 205 and 215, in order to optimally provide a durable and consistent lubricating effect. In a preferred embodiment, the force that bonds the lubricant to the interior surfaces of the first and second tubular members, 205 and 215, is greater than the shear force applied during the radial expansion process.

In a preferred embodiment, the coating 240 of lubricant is applied to the interior surfaces of the first and second tubular members, 205 and 215, by first applying a phenolic primer to the interior surfaces of the first and second tubular members, 205 and 215, and then bonding the coating 240 of lubricant to the phenolic primer using an antifriction paste having the coating 240 of lubricant carried in an epoxy resin. In a preferred embodiment, the antifriction paste includes, by weight, 40–80% epoxy resin, 15–30% molybdenum disulfide, 10–15% graphite, 5–10% aluminum, 5–10% copper, 8–15% alumisilicate, and 5–10% polyethylenepolyamine. In a preferred embodiment, the antifriction paste is provided substantially as disclosed in U.S. Pat. No. 4,329,238, the disclosure of which is incorporate herein by reference.

The coating 240 of lubricant may be any number of conventional commercially available lubricants such as, for example, metallic soaps or zinc phosphates. In a preferred embodiment, the coating 240 of lubricant is compatible with conventional water, oil and synthetic base mud formulations. In a preferred embodiment, the coating 240 of lubricant reduces metal-to-metal frictional forces, operating pressures, reduces frictional forces by about 50%, and provides a coefficient of dynamic friction of between about 0.08 to 0.1 during the radial expansion process. In a preferred embodiment, the coating 240 of lubricant does not increase the toxicity of conventional base mud formulations and will not sheer in synthetic mud. In a preferred embodiment, the coating 240 of lubricant is stable for temperatures ranging from about −100 to 500° F. In a preferred embodiment, the coating 240 of lubricant is stable when exposed to shear stresses. In a preferred embodiment, the coating 240 of lubricant is stable for storage periods of up to about 5 years. In a preferred embodiment, the coating 240 of lubricant provides corrosion protection for expandable tubular members during storage and transport.

In a preferred embodiment, the coating 240 of lubricant includes sodium, calcium, and/or zinc stearates; and/or zinc and/or manganese phosphates; and/or C-Lube-10; and/or C-Phos-58-M; and/or C-Phos-58-R; and/or polytetrafluoroethylene (PTFE); and/or molybdenum disulfide; and/or metallic soaps (stearates, oleates, etc. . . ) in order to optimally provide a coating of lubricant. In a preferred embodiment, the coating 240 of lubricant provides a sliding coefficient of friction less than about 0.20 in order to optimally reduce the force required to radially expand the tubular members, 205 and 215, using an expansion cone.

In a preferred embodiment, in step 115, the first and second tubular members, 205 and 215, are coupled. The first and second tubular members, 205 and 215, may be coupled using a threaded connection, or, alternatively, the first and second tubular members, 205 and 215, may be coupled by welding or brazing. In a preferred embodiment, the first and second tubular members, 205 and 215, are coupled substantially as disclosed in provisional patent application serial No. 60/159,033, filed on Oct. 12, 1999, the disclosure of which is incorporated herein by reference.

Figure 3:
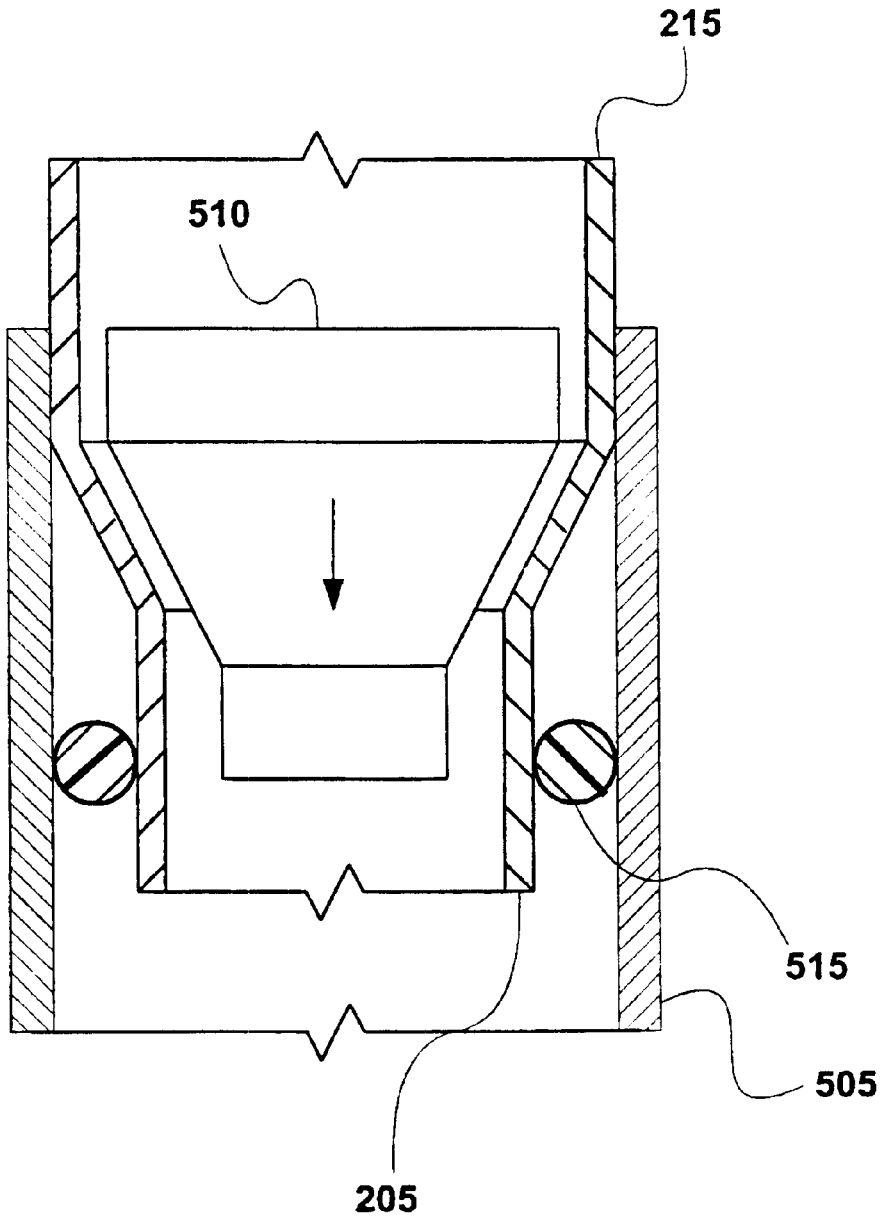
FIG. 3 is a fragmentary cross sectional illustration of the radial expansion of the tubular members of FIG. 2 into contact with a preexisting structure.

As illustrated in FIG. 3, in steps 120, the first and second tubular members 205 and 215 are then positioned within a preexisting structure 505, and radially expanded into contact with the interior walls of the preexisting structure 505 using an expansion cone 510. The tubular members 205 and 215 may be radially expanded into intimate contact with the interior walls of the preexisting structure 505, for example, by: (1) pushing or pulling the expansion cone 510 through the interior of the tubular members 205 and 215; and/or (2) pressurizing the region within the tubular members 205 and 215 behind the expansion cone 510 with a fluid. In a preferred embodiment, one or more sealing members 515 are further provided on the outer surface of the tubular members 205 and 215, in order to optimally seal the interface between the radially expanded tubular members 205 and 215 and the interior walls of the preexisting structure 505.

In a preferred embodiment, the radial expansion of the tubular members 205 and 215 into contact with the interior walls of the preexisting structure 505 is performed substantially as disclosed in one or more of the following co-pending patent applications:

| U.S. Provisional patent application Ser. No. | Attorney Docket No. | Filing Date |
|---|---|---|
| 60/108,558 | 25791.9 | Nov. 16, 1998 |
| 60/111,293 | 25791.3 | Dec. 7, 1998 |
| 60/119,611 | 25791.8 | Feb. 11, 1999 |
| 60/121,702 | 25791.7 | Feb. 25, 1999 |
| 60/121,841 | 25791.12 | Feb. 26, 1999 |
| 60/121,907 | 25791.16 | Feb. 26, 1999 |
| 60/124,042 | 25791.11 | Mar. 11, 1999 |
| 60/131,106 | 25791.23 | Apr. 26, 1999 |
| 60/137,998 | 25791.17 | June 7, 1999 |
| 60/143,039 | 25791.26 | Jul. 9, 1999 |
| 60/146,203 | 25791.25 | Jul. 29, 1999 |
| 60/154,047 | 25791.29 | Sept. 16, 1999 |
| 60/159,082 | 25791.34 | Oct. 12, 1999 |
| 60/159,039 | 25791.36 | Oct. 12, 1999 |
| 60/159,033 | 25791.37 | Oct. 12, 1999 |
| 60/162,671 | 25791.27 | Nov. 01, 1999 |

The disclosures of each of the above co-pending patent applications are incorporated by reference.

Figure 4:
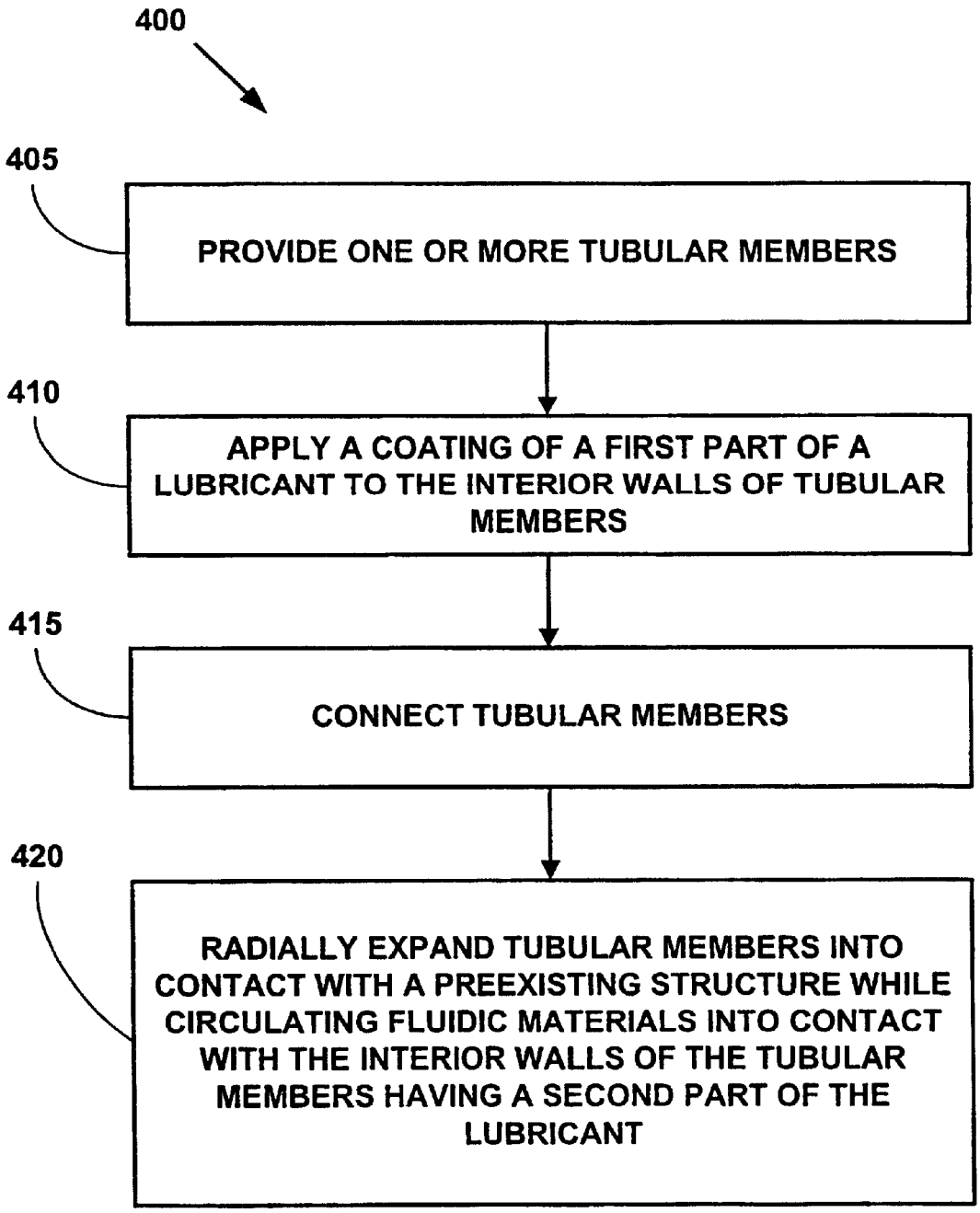
FIG. 4 is a flow chart illustrating an alternative preferred embodiment of a method for coupling a plurality of tubular members to a preexisting structure.

As illustrated in FIG. 4, an alternate embodiment of a method 400 for forming and/or repairing a wellbore casing, pipeline, or structural support includes the steps of: (1) providing one or more tubular members in step 405; (2) applying a coating including a first part of a lubricant to the interior walls of the tubular members in step 410; (3) coupling the first and second tubular members in step 415; and (4) radially expanding the tubular members into contact with the preexisting structure while also circulating fluidic materials into contact with the interior walls of the tubular members having a second part of the lubricant in step 420.

In a preferred embodiment, in step 410, a coating including a first part of a lubricant is applied to the interior walls of the tubular members, 205 and 215. In a preferred embodiment, the first part of the lubricant forms a first part of a metallic soap. In an preferred embodiment, the first part of the lubricant coating includes zinc phosphate.

In a preferred embodiment, in step 420, a second part of the lubricant is circulated within a fluidic carrier into contact with the coating of the first part of the lubricant applied to the interior walls of the tubular members, 205 and 215. In a preferred embodiment, the first and second parts react to form a lubricating layer between the interior walls of the tubular members, 205 and 215, and the exterior surface of the expansion cone. In this manner, a lubricating layer is provided in exact concentration, exactly when and where it is needed. Furthermore, because the second part of the lubricant is circulated in a carrier fluid, the dynamic interface between the interior surfaces of the tubular members, 205 and 215, and the exterior surface of the expansion cone 510 is also preferably provided with hydrodynamic lubrication. In a preferred embodiment, the first and second parts of the lubricant react to form a metallic soap. In a preferred embodiment, the second part of the lubricant is sodium, calcium and/or zinc stearate.

In several experimental exemplary embodiments of the methods 100 and 400, the following observations were made regarding lubricant coatings for expandable tubular members:

(1) boundary lubrication with a lubricant coating having high adhesion (high film/shear strength) to the expandable tubular is the single most important lubricant/lubrication process in the radial expansion process;

(2) hydrodynamic lubrication plays a secondary role in the lubrication process;

(3) expandable tubular lubricant coating offers the more reliable and more effective form of boundary lubrication;

(4) a liquid lubricant viscosity and/or film strength that provides effective, consistent boundary lubrication typically limits the effectiveness of additives for the mud alone to provide the necessary lubrication while maintaining drilling fluid properties (rheology, toxicity);

(5) consistent reductions of 20 to 25 percent in propagation force during the radial expansion process (compared to uncoated expandable tubular control results) were obtained with the following dry film coatings: (1) polytetrafluoroethylene (PTFE), (2) molybdenum disulfide, and (3) metallic soap (stearates), these results are for laboratory tests on one inch dry pipe, in the absence of any drilling fluid;

(6) a 20 to 25 percent reduction in propagation force during the radial expansion process was observed;

(7) synthetic oil muds do not typically provide sufficient, reliable lubrication for uncoated pipe;

(8) the coefficient of friction for expandable tubular lubricant coatings remains essentially constant across a wide temperature range;

(9) the expected application range for expandable tubular casing expansion is between 40° F. and 400° F., this range is well within the essentially constant range for coefficient of friction for good coatings; and

(10) good extreme pressure boundary lubricants have a characteristic of performing better (lower coefficients of friction) as the load increases, coefficients of friction between 0.02 and 0.08 are reported for some coatings.

In a preferred embodiment, the optimum lubrication for in-situ expandable tubular radial expansion operations using the methods 100 and/or 400 includes a combination of lubrication techniques and lubricants. These can be summarized as follows: (1) extreme pressure lubricants/lubrication techniques; and (2) hydrodynamic lubrication from the fluid in the pipe during expansion.

Extreme pressure lubrication is preferably provided by: (1) liquid extreme pressure lubricants added to the fluid (e.g., drilling fluid, etc) in contact with the internal surface of the expandable tubular during the radial expansion process, and/or (2) solid lubricants added to the fluid added to, or contained within, the fluid in contact with the internal surface of the expandable tubular member during the radial expansion process, and/or (3) solid lubricants applied to the internal surface of the expandable tubular member to be radially expanded, and/or (4) combinations of (1), (2) and (3) above.

Liquid extreme pressure lubricant additives preferably work by chemically adhering to or being strongly attracted to the surface of the expandable tubular to be expanded. These types of liquid extreme pressure lubricant additives preferably form a 'film' on the surface of the expandable tubular member. The adhesive strength of this film is preferably greater than the shearing force along the internal surface of the expandable tubular member during the radial expansion process. This adhesive force is referred to as film strength. The film strength can be increased by increasing the viscosity of the fluid. Common viscosifiers, such as polymeric additives, are preferably added to the fluid in contact with the internal surface of the expandable tubular member during the radial expansion process to increase lubrication. In a preferred embodiment, these liquid extreme pressure lubricant additives include one or more of the following: polyacrylamide polymers, AMPS-acrylamide copolymers, modified cellulose derivatives such as, for example, hydroxyethylcellulose, carboxymethyl hydroxyethyl cellulose, polyvinyl alcohol polymers, polyvinyl acetate polymers, polyvinyl alcohol/vinyl acetate copolymers, polyvinyl pyrrolidone and copolymers including polyolefins, latexes such as, for example, styrene butadiene latex, urethane latexes, styrene-maleic annhydride copolymers, viscosity index improvers for motor oils such as polyacrylate esters, block copolymers including styrene, isoprene butadiene and ethylene, ethylene acrylic acid copolymers.

In a preferred embodiment, extreme pressure lubrication is provided using solid lubricants that are applied to the internal surface of the expandable tubular member. These solid lubricants can be applied using various conventional methods of applying a film to a surface. In a preferred embodiment, these solid lubricants are applied in a manner that ensures that the solid lubricants remain on the surface of the expandable tubular member during installation and radial expansion of the expandable tubular member. The solid lubricants preferably include one or more of the following: graphite, molybdenum disulfide, lead powder, antimony oxide, poly tetrafluoroethylene (PTFE), or silicone polymers. Furthermore, blends of these solid lubricants are preferred.

In a preferred embodiment, the solid lubricants are applied directly to the expandable tubulars as coatings. The coating of the solid lubricant preferably includes a binder to help hold or fix the solid lubricant to the expandable tubular. The binders preferably include curable resins such as, for example, epoxies, acrylic, urea-formaldehyde, melamine formaldehyde, furan based resins, acetone formaldehyde, phenolic, alkyd resins, silicone modified alkyd resins, etc. The binder is preferably selected to withstand the expected temperature range, pH, salinity and fluid types during the installation and radial expansion operations. Polymeric materials are preferably used to bind the solid lubricants to the expandable tubular such as, for example, "self-adhesive" polymers such as those copolymers or terpolymers based upon vinyl acetate, vinyl chloride, maleic annhydride/maleic acid, and ethylene-acrylic acid copolymers, ethylene-methacrylic acid copolymers and ethylene-vinyl acetate copolymers. In an alternative embodiment, the solid lubricants are applied as suspensions of fine particles in a carrier solvent without the presence/use of a chemical binder.

In a preferred embodiment, the solid lubricant coating and the liquid lubricant additive (added to the fluid in contact with the internal surface of the expandable tubular member during the radial expansion process) interact during the radial expansion process to improve the overall lubrication. In an exemplary embodiment, for phosphate solid lubricant coatings, manganese phosphate is preferred over zinc or iron phosphate because it more effectively attracts and retains liquid lubricant additives such as oils, esters, amides, etc.

In a preferred embodiment, solid lubricant coatings use binders that provide low friction that is enhanced under extreme pressure conditions by the presence of the solid lubricant. Preferred solid lubricant coatings includes one or more of the following: graphite, molybdenum disulfide, silicone polymers and polytetrafluoroethylene (PTFE). In a preferred embodiment, blends of these materials are used since each material has lubrication characteristics that optimally work at different stages in the radial expansion process. In a preferred embodiment, a solid, dry film lubricant coating for the internal surface of the expandable tubular includes: (1) 1 to 90 percent solids by volume; (2) more preferably, 5 to 70 percent solids by volume; and (3) most preferably, 15 to 50 percent solids by volume. In a preferred embodiment, the solid lubricants include: (1) 5 to 80 percent graphite; (2) 5 to 80 percent molybdenum disulfide; (3) 1 to 40 percent PTFE; and (4) 1 to 40 percent silicone polymers.

In several exemplary embodiment, the liquid lubricant additives include one or more of the following: (1) esters including: (a) organic acid esters (preferably fatty acid esters) such as, for example, trimethylol propane, isopropyl, penterithritol, n-butyl, etc.; (b) glycerol tri(acetoxy stearate) and N,N' ethylene bis 12 hydroxystearate and octyl hydroxystearate; (c) phosphate and phosphite such as, for example, butylated triphenyl phosphate and isodiphenyl phosphate; (2) sulfurized natural and synthetic oils; (3) alkanolamides such as, for example, coco diethanolamide; (4) amines and amine salts; (5) olefins and polyolefins; (6) C-8 to C-18 linear alcohols and derivatives containing or consisting of esters, amines, carboxylates, etc.; (7) overbased sulfonates such as, for example, calcium sulfonate, sodium sulfonate, magnesium sulfonate; (8) polyethylene glycols; (9) silicones and siloxanes such as, for example, dimethylpolysiloxanes and fluorosilicone derivatives; (10) dinonyl phenols; and (11) ethylene oxide/propylene oxide block copolymers.

An expandable tubular assembly has been described that includes one or more tubular members and a layer of a lubricant coupled to the interior surfaces of the tubular members. In a preferred embodiment, the lubricant includes a metallic soap. In a preferred embodiment, the lubricant is selected from the group consisting of sodium, calcium, and/or zinc stearates, zinc phosphates, manganese phosphate, C-Lube-10, C-PHOS-58-M, C-PHOS-58-R, graphite, molybdenum disulfide, lead powder, antimony oxide, poly tetrafluoroethylene (PTFE), and silicone polymers. In a preferred embodiment, the lubricant provides a sliding friction coefficient of less than about 0.20. In a preferred embodiment, the lubricant is chemically bonded to the interior surfaces of the tubular members. In a preferred embodiment, the lubricant is mechanically bonded to the interior surfaces of the tubular members. In a preferred embodiment, the lubricant is adhesively bonded to the interior surface of the tubular members. In a preferred embodiment, the lubricant includes epoxy, molybdenum disulfide, graphite, aluminum, copper, alumisilicate and polyethylenepolyamine. In a preferred embodiment, the layer of lubricant includes: a binder and a solid lubricant material. In a preferred embodiment, the binder is selected from the group consisting of: epoxy, acrylic, urea-formaldehyde, phenolic, alkyd resins, silicone modified alkyd resins, vinyl acetate, vinyl chloride, and maleic annhydride/maelic acid. In a preferred embodiment, the solid lubricant material is selected from the group consisting of: graphite, molybdenum disulfide, silicone polymers, and polytetrafluoroethylene. In a preferred embodiment, the solid lubricant material includes: graphite, molybdenum disulfide, polytetrafluoroethylene, and silicone polymers. In a preferred embodiment, the solid lubricant material includes: about 5 to 80 percent of graphite, about 5 to 80 percent of molybdenum disulfide, about 1 to 40 percent polytetrafluoroethylene, and about 1 to 40 percent silicone polymers. In a preferred embodiment, the layer of lubricant includes about 1% to 90% of the solid lubricant material by volume. In a preferred embodiment, the layer of lubricant includes about 5% to 70% of the solid lubricant material by volume. In a preferred embodiment, the layer of lubricant includes about 15% to 50% of the solid lubricant material by volume.

A method of coupling an expandable tubular assembly including one or more tubular members to a preexisting structure has also been described that includes coating the interior surfaces of the tubular members with a lubricant, positioning the tubular members within a preexisting structure and radially expanding the tubular members into contact with the preexisting structure. In a preferred embodiment, the lubricant coating includes a metallic soap. In a preferred embodiment, the lubricant coating is selected from the group consisting of sodium, calcium, and/or zinc stearates, zinc phosphates, manganese phosphate, C-Lube-10, C-PHOS-58-M, C-PHOS-58-R, graphite, molybdenum disulfide, lead powder, antimony oxide, poly tetrafluoroethylene (PTFE), and silicone polymers. In a preferred embodiment, the lubricant coating provides a sliding friction coefficient of less than about 0.20. In a preferred embodiment, the lubricant coating is chemically bonded to the interior surfaces of the tubular members. In a preferred embodiment, the lubricant coating is mechanically bonded to the interior surfaces of the tubular members. In a preferred embodiment, the lubricant coating is adhesively bonded to the interior surface of the tubular members. In a preferred embodiment, the lubricant coating includes epoxy, molybdenum disulfide, graphite, aluminum, copper, alumisilicate and polyethylene-polyamine. In a preferred embodiment, the lubricant coating includes: a binder, and a solid lubricant material. In a preferred embodiment, the binder is selected from the group consisting of: epoxy, acrylic, urea-formaldehyde, phenolic, alkyd resins, silicone modified alkyd resins, vinyl acetate, vinyl chloride, and maleic annhydride/maelic acid. In a preferred embodiment, the solid lubricant material is selected from the group consisting of: graphite, molybdenum disulfide, silicone polymers, and polytetrafluoroethylene. In a preferred embodiment, the solid lubricant material includes: graphite, molybdenum disulfide, polytetrafluoroethylene, and silicone polymers. In a preferred embodiment, the solid lubricant material includes: about 5 to 80 percent of graphite, about 5 to 80 percent of molybdenum disulfide, about 1 to 40 percent polytetrafluoroethylene, and about 1 to 40 percent silicone polymers. In a preferred embodiment, the lubricant coating includes about 1% to 90% of the solid lubricant material by volume. In a preferred embodiment, the lubricant coating includes about 5% to 70% of the solid lubricant material by volume. In a preferred embodiment, the lubricant coating includes about 15% to 50% of the solid lubricant material by volume. In a preferred embodiment, the method further includes: injecting a quantity of a lubricating material into contact with the expandable tubular assembly. In a preferred embodiment, the lubricant coating includes a first part of a lubricating substance; and the lubricating material includes a second part of the lubricating substance.

An apparatus has also been described that includes a preexisting structure and one or more tubular members coupled to the preexisting structure. The tubular members are coupled to the preexisting structure by the process of: coating the interior surfaces of the tubular members with a lubricant, positioning the tubular members within a preexisting structure, and radially expanding the tubular members into contact with the preexisting structure. In a preferred embodiment, the lubricant coating includes a metallic soap. In a preferred embodiment, the lubricant coating is selected from the group consisting of sodium, calcium, and/or zinc stearates, zinc phosphates, manganese phosphate, C-Lube-10, C-PHOS-58-M, C-PHOS-58-R, graphite, molybdenum disulfide, lead powder, antimony oxide, poly tetrafluoroethylene (PTFE), and silicone polymers. In a preferred embodiment, the lubricant coating provides a sliding friction coefficient of less than about 0.20. In a preferred embodiment, the lubricant coating is chemically bonded to the interior surfaces of the tubular members. In a preferred embodiment, the lubricant coating is mechanically bonded to the interior surfaces of the tubular members. In a preferred embodiment, the lubricant coating is adhesively bonded to the interior surface of the tubular members. In a preferred embodiment, the lubricant coating includes epoxy, molybdenum disulfide, graphite, aluminum, copper, alumisilicate and polyethylenepolyamine. In a preferred embodiment, the lubricant coating includes: a binder and a solid lubricant material. In a preferred embodiment, the binder is selected from the group consisting of: epoxy, acrylic, urea-formaldehyde, phenolic, alkyd resins, silicone modified alkyd resins, vinyl acetate, vinyl chloride, and maleic annhydride/maelic acid. In a preferred embodiment, the solid lubricant material is selected from the group consisting of: graphite, molybdenum disulfide, silicone polymers, and polytetrafluoroethylene. In a preferred embodiment, the solid lubricant material includes: graphite, molybdenum disulfide, polytetrafluoroethylene, and silicone polymers. In a preferred embodiment, the solid lubricant material includes: about 5 to 80 percent of graphite, about 5 to 80 percent of molybdenum disulfide, about 1 to 40 percent polytetrafluoroethylene, and about 1 to 40 percent silicone polymers. In a preferred embodiment, the lubricant coating includes about 1% to 90% of the solid lubricant material by volume. In a preferred embodiment, the lubricant coating includes about 5% to 70% of the solid lubricant material by volume. In a preferred embodiment, the lubricant coating includes about 15% to 50% of the solid lubricant material by volume. In a preferred embodiment, the method further includes: injecting a quantity of a lubricating material into contact with the expandable tubular assembly. In a preferred embodiment, the lubricant coating includes a first part of a lubricating substance; and the injected lubricating material includes a second part of the lubricating substance.

An expandable tubular assembly has also been described that includes one or more tubular members and a layer of a first part of a lubricant coupled to the interior surfaces of the tubular members. In a preferred embodiment, the lubricant includes a metallic soap. In a preferred embodiment, the lubricant is selected from the group consisting of sodium, calcium, and/or zinc stearates, zinc phosphates, manganese phosphate, C-Lube-10, C-PHOS-58-M, C-PHOS-58-R, graphite, molybdenum disulfide, lead powder, antimony oxide, poly tetrafluoroethylene (PTFE), and silicone polymers. In a preferred embodiment, the lubricant provides a sliding friction coefficient of less than about 0.20. In a preferred embodiment, the lubricant is chemically bonded to the interior surfaces of the tubular members. In a preferred embodiment, the lubricant is mechanically bonded to the interior surfaces of the tubular members. In a preferred embodiment, the lubricant is adhesively bonded to the interior surface of the tubular members. In a preferred embodiment, the lubricant includes epoxy, molybdenum disulfide, graphite, aluminum, copper, alumisilicate and polyethylenepolyamine. In a preferred embodiment, the layer of lubricant includes: a binder and a solid lubricant material. In a preferred embodiment, the binder is selected from the group consisting of: epoxy, acrylic, urea-formaldehyde, phenolic, alkyd resins, silicone modified alkyd resins, vinyl acetate, vinyl chloride, and maleic annhydride/maelic acid. In a preferred embodiment, the solid lubricant material is selected from the group consisting of: graphite, molybdenum disulfide, silicone polymers, and polytetrafluoroethylene. In a preferred embodiment, the solid lubricant material includes: graphite, molybdenum disulfide, polytetrafluoroethylene, and silicone polymers. In a preferred embodiment, the solid lubricant material includes: about 5 to 80 percent of graphite, about 5 to 80 percent of molybdenum disulfide, about 1 to 40 percent polytetrafluoroethylene, and about 1 to 40 percent silicone polymers. In a preferred embodiment, the layer of lubricant includes about 1% to 90% of the solid lubricant material by volume. In a preferred embodiment, the layer of lubricant includes about 5% to 70% of the solid lubricant material by volume. In a preferred embodiment, the layer of lubricant includes about 15% to 50% of the solid lubricant material by volume.

A method of coupling an expandable tubular assembly including one or more tubular members to a preexisting structure has also been described that includes positioning the expandable tubular assembly into the preexisting structure, injecting a quantity of a lubricant material into contact with the expandable tubular assembly, and radially expanding the expandable tubular assembly into contact with the preexisting structure. In a preferred embodiment, the injected lubricant material includes a liquid lubricant material. In a preferred embodiment, the liquid lubricant material is selected from the group consisting of: polyacrylamide polymers, AMPS-acrylamide copolymers, modified cellulose derivatives, hydroxyethylcellulose, carboxymethyl hydroxyethyl cellulose, polyvinyl alcohol polymers, polyvinyl acetate polymers, polyvinyl alcohol/vinyl acetate copolymers, polyvinyl pyrrolidone, copolymers including polyolefins, latexes, styrene butadiene latex, urethane latexes, styrene-maleic annhydride copolymers, viscosity index improvers for motor oils, polyacrylate esters, block copolymers including styrene, isoprene butadiene and ethylene, ethylene acrylic acid copolymers, esters, organic acid esters, trimethylol propane, isopropyl, penterithritol, n-butyl, glycerol triacetoxy stearate, N,N' ethylene bis 12 hydroxystearate, octyl hydroxystearate, phosphate, phosphite, butylated triphenyl phospate, isodiphenyl phosphate, sulfurized natural oils, synthetic oils, alkanolamides, coco diethanolamide, amines, amine salts, olefins, polyolefins, C-8 to C-18 linear alcohols and derivatives including esters, amines, carboxylates, overbased sulfonates, calcium sulfonate, sodium sulfonate, magnesium sulfonate, polyethylene glycols, silicones, siloxanes, dimethylpolysiloxanes, fluorosilicone derivatives, dinonyl phenols, and ethylene oxide/propylene oxide block copolymers. In a preferred embodiment, the injected lubricant material includes a solid lubricant material. In a preferred embodiment, the solid lubricant material is selected from the group consisting of: graphite, molybdenum disulfide, lead powder, antimony oxide, poly tetrafluoroethylene, and silicone polymers. In a preferred embodiment, the method further includes: coating the interior surfaces of the tubular members with a lubricant prior to positioning the tubular members within the preexisting structure. In a preferred embodiment, the lubricant coating includes a first part of a lubricating substance; and the injected lubricating material includes a second part of the lubricating substance.

An apparatus has also been described that includes a preexisting structure and one or more tubular members coupled to the preexisting structure. The tubular members are coupled to the preexisting structure by the process of: positioning the tubular members into the preexisting structure, injecting a quantity of a lubricant material into contact with the tubular members, and radially expanding the tubular members into contact with the preexisting structure. In a preferred embodiment, the injected lubricant material includes a liquid lubricant material. In a preferred embodiment, the liquid lubricant material is selected from the group consisting of: polyacrylamide polymers, AMPS-acrylamide copolymers, modified cellulose derivatives, hydroxyethylcellulose, carboxymethyl hydroxyethyl cellulose, polyvinyl alcohol polymers, polyvinyl acetate polymers, polyvinyl alcohol/vinyl acetate copolymers, polyvinyl pyrrolidone, copolymers including polyolefins, latexes, styrene butadiene latex, urethane latexes, styrene-maleic annhydride copolymers, viscosity index improvers for motor oils, polyacrylate esters, block copolymers including styrene, isoprene butadiene and ethylene, ethylene acrylic acid copolymers, esters, organic acid esters, trimethylol propane, isopropyl, penterithritol, n-butyl, glycerol triacetoxy stearate, N,N' ethylene bis 12 hydroxystearate, octyl hydroxystearate, phosphate, phosphite, butylated triphenyl phospate, isodiphenyl phosphate, sulfurized natural oils, synthetic oils, alkanolamides, coco diethanolamide, amines, amine salts, olefins, polyolefins, C-8 to C-18 linear alcohols and derivatives including esters, amines, carboxylates, overbased sulfonates, calcium sulfonate, sodium sulfonate, magnesium sulfonate, polyethylene glycols, silicones, siloxanes, dimethylpolysiloxanes, fluorosilicone derivatives, dinonyl phenols, and ethylene oxide/propylene oxide block copolymers. In a preferred embodiment, the injected lubricant material includes a solid lubricant material. In a preferred embodiment, the solid lubricant material is selected from the group consisting of: graphite, molybdenum disulfide, lead powder, antimony oxide, poly tetrafluoroethylene, and silicone polymers. In a preferred embodiment, the apparatus further includes: coating the interior surfaces of the tubular members with a lubricant prior to positioning the tubular members within the preexisting structure. In a preferred embodiment, the lubricant coating includes a first part of a lubricating substance; and the injected lubricating material includes a second part of the lubricating substance.

A method of coupling an expandable tubular assembly including one or more tubular members to a preexisting structure has also been described that includes: coating the interior surfaces of the tubular members with a first part of a lubricant, positioning the tubular members within a preexisting structure, circulating a fluidic material including a second part of the lubricant into contact with the coating of the first part of the lubricant, and radially expanding the tubular members into contact with the preexisting structure. In a preferred embodiment, the lubricant includes a metallic soap. In a preferred embodiment, the lubricant is selected from the group consisting of sodium, calcium, and/or zinc stearates, zinc phosphates, manganese phosphate, C-Lube-10, C-PHOS-58-M, and C-PHOS-58-R. In a preferred embodiment, the lubricant provides a sliding friction coefficient of less than about 0.20. In a preferred embodiment, the first part of the lubricant is chemically bonded to the interior surfaces of the tubular members. In a preferred embodiment, the first part of the lubricant is mechanically bonded to the interior surfaces of the tubular members. In a preferred embodiment, the first part of the lubricant is adhesively bonded to the interior surface of the tubular members. In a preferred embodiment, the method further includes: combining the first and second parts of the lubricant to generate the lubricant.

An apparatus has also been described that includes a preexisting structure and one or more tubular members coupled to the preexisting structure. The tubular members are coupled to the preexisting structure by the process of: coating the interior surfaces of the tubular members with a first part of a lubricant, positioning the tubular members within a preexisting structure, circulating a fluidic materials having a second part of the lubricant into contact with the coating of the first part of the lubricant, and radially expanding the tubular members into contact with the preexisting structure. In a preferred embodiment, the lubricant includes a metallic soap. In a preferred embodiment, the lubricant is selected from the group consisting of sodium, calcium, and/or zinc stearates, zinc phosphates, manganese phosphate, C-Lube-10, C-PHOS-58-M, and C-PHOS-58-R. In a preferred embodiment, the lubricant provides a sliding friction coefficient of less than about 0.20. In a preferred embodiment, the first part of the lubricant is chemically bonded to the interior surfaces of the tubular members. In a preferred embodiment, the first part of the lubricant is mechanically bonded to the interior surfaces of the tubular members. In a preferred embodiment, the first part of the lubricant is adhesively bonded to the interior surface of the tubular members. In a preferred embodiment, the apparatus further includes combining the first and second parts of the lubricant to generate the lubricant.

Although this detailed description has shown and described illustrative embodiments of the invention, this description contemplates a wide range of modifications, changes, and substitutions. In some instances, one may employ some features of the present invention without a corresponding use of the other features. Accordingly, it is appropriate that readers should construe the appended claims broadly, and in a manner consistent with the scope of the invention.

What is claimed is:

1. A method of coupling an expandable tubular assembly including one or more tubular members to a preexisting structure, comprising:

coating the interior surfaces of the tubular members with a lubricant;

positioning the tubular members within a preexisting structure; and radially expanding the tubular members into contact with the preexisting structure.

2. An apparatus, comprising:

a preexisting structure; and one or more tubular members coupled to the preexisting structure by the process of:

coating the interior surfaces of the tubular members with a lubricant;

positioning the tubular members within a preexisting structure; and radially expanding the tubular members into contact with the preexisting structure.

3. A method of coupling an expandable tubular assembly including one or more tubular members to a preexisting structure, comprising:

positioning the expandable tubular assembly into the preexisting structure;

injecting a quantity of a lubricant material into contact with the expandable tubular assembly; and radially expanding the expandable tubular assembly into contact with the preexisting structure.

4. An apparatus, comprising:

a preexisting structure; and one or more tubular members coupled to the preexisting structure by the process of:

positioning the tubular members into the preexisting structure;

injecting a quantity of a lubricant material into contact with the tubular members; and radially expanding the tubular members into contact with the preexisting structure.

5. A method of coupling an expandable tubular assembly including one or more tubular members to a preexisting structure, comprising:

coating the interior surfaces of the tubular members with a first part of a lubricant;

positioning the tubular members within a preexisting structure;

circulating a fluidic material including a second part of the lubricant into contact with the coating of the first part of the lubricant; and radially expanding the tubular members into contact with the preexisting structure.

6. An apparatus, comprising:

a preexisting structure; and one or more tubular members coupled to the preexisting structure by the process of:

coating the interior surfaces of the tubular members with a first part of a lubricant;

positioning the tubular members within a preexisting structure;

circulating a fluidic materials having a second part of the lubricant into contact with the coating of the first part of the lubricant; and radially expanding the tubular members into contact with the preexisting structure.

7. An expandable tubular assembly, comprising:

one or more tubular members; and a layer of a lubricant coupled to the interior surfaces of the tubular members;

wherein the tubular members comprise wellbore casings.

8. An expandable tubular assembly, comprising:

one or more tubular members; and a layer of a lubricant coupled to the interior surfaces of the tubular members;

wherein the tubular members comprise underground pipes.

9. An expandable tubular assembly, comprising:

one or more tubular members; and a layer of a lubricant coupled to the interior surfaces of the tubular members;

wherein the tubular members comprise structural supports.

10. An expandable tubular assembly, comprising:

one or more tubular members; and a layer of a lubricant coupled to the interior surfaces of the tubular members;

wherein the coating of lubricant is chemically bonded to the interior surfaces of the tubular members.

11. An expandable tubular assembly, comprising:

one or more tubular members; and a layer of a lubricant coupled to the interior surfaces of the tubular members;

wherein the coating of lubricant is mechanically bonded to the interior surfaces of the tubular members.

12. An expandable tubular assembly, comprising:

one or more tubular members; and a layer of a lubricant coupled to the interior surfaces of the tubular members;

wherein the coating of lubricant is adhesively bonded to the interior surfaces of the tubular members.

13. An expandable tubular assembly, comprising:

one or more tubular members; and a layer of a lubricant coupled to the interior surfaces of the tubular members;

wherein the coating of lubricant includes:

a primer coating coupled to the interior surfaces of the tubular members; and a coating of an antifriction paste coupled to the primer.

14. An expandable tubular assembly, comprising:

one or more tubular members; and a layer of a lubricant coupled to the interior surfaces of the tubular members;

wherein the coating of lubricant includes, by weight:

40–80% epoxy resin, 15–30% molybdenum disulfide, 10–15% graphite, 5–10% aluminum, 5–10% copper, 8–15% alumisilicate, and 5–10% polyethylenepolyamine.

15. An expandable tubular assembly, comprising:

one or more tubular members; and a layer of a lubricant coupled to the interior surfaces of the tubular members;

wherein the coating of lubricant comprises a metallic soap.

16. An expandable tubular assembly, comprising:

one or more tubular members; and a layer of a lubricant coupled to the interior surfaces of the tubular members;

wherein the coating of lubricant comprises zinc phosphate.

17. An expandable tubular assembly, comprising:

one or more tubular members; and a layer of a lubricant coupled to the interior surfaces of the tubular members;

wherein the coating of lubricant provides a coefficient of dynamic friction of between about 0.08 to 0.

18. An expandable tubular assembly, comprising:

one or more tubular members; and a layer of a lubricant coupled to the interior surfaces of the tubular members;

wherein the coating of lubricant is selected from the group consisting of:

sodium stearates, calcium stearates, zinc stearates, zinc phosphate, manganese phosphate, C-Lube-10, C-Phos-58-M, C-Phos-58-R, polytetrafluoroethylene, molybdenum disulfide, and metallic soaps.

19. An expandable tubular assembly, comprising:

one or more tubular members; and a layer of a lubricant coupled to the interior surfaces of the tubular members;

wherein the coating of lubricant provides a sliding coefficient of friction less than about 0.20.

20. An expandable tubular assembly, comprising:

one or more tubular members; and a layer of a lubricant coupled to the interior surfaces of the tubular members;

wherein the coating of lubricant is selected from the group consisting of:

polyacrylamide polymers, AMPS-acrylamide copolymers, modified cellulose derivatives, hydroxyethylcellulose, carboxymethyl hydroxyethyl cellulose, polyvinyl alcohol polymers, polyvinyl acetate polymers, polyvinyl alcohol acetate copolymers, polyvinyl vinyl acetate copolymers, polyvinyl pyrrolidone and copolymers including polyolefins, latexes, styrene butadiene latex, urethane latexes, styrene-maleic annhydride copolymers, viscosity index improvers for motor oils, polyacrylate esters, block copolymers including styrene, block copolymers including isoprene butadiene, block copolymers including ethylene, and ethylene acrylic acid copolymers.

21. An expandable tubular assembly, comprising:

one or more tubular members; and a layer of a lubricant coupled to the interior surfaces of the tubular members;

wherein the coating of lubricant is selected from the group consisting of:

graphite, molybdenum disulfide, lead powder, antimony oxide, poly tetrafluoroethylene, and silicone polymers.

22. An expandable tubular assembly, comprising:

one or more tubular members; and a layer of a lubricant coupled to the interior surfaces of the tubular members;

wherein the coating of lubricant comprises:

a solid lubricant; and a binder.

23. The expandable tubular assembly of claim 22, wherein the binder is selected from the group consisting of:

epoxy, acrylic, urea-formaldehyde, melamine formaldehyde, furan based resin, acetone formaldehyde, phenolic, alkyd resins, and silicone modified alkyd resin.

24. The expandable tubular assembly of claim 22, wherein the binder is selected from the group consisting of:

vinyl acetate, vinyl chloride, maleic annhydride, maleic acid, ethylene-acrylic acid copolymers, ethylene-methacrylic acid copolymers, and ethylene-vinyl acetate copolymers.

25. An expandable tubular assembly, comprising:

one or more tubular members; and a layer of a lubricant coupled to the interior surfaces of the tubular members;

wherein the coating of lubricant comprises a suspension of particles in a carrier solvent.

26. An expandable tubular assembly, comprising:

one or more tubular members; and a layer of a lubricant coupled to the interior surfaces of the tubular members;

the coating of lubricant is selected from the group consisting of:

manganese phosphate, zinc phosphate, and iron phosphate.

27. An expandable tubular assembly, comprising:

one or more tubular members; and a layer of a lubricant coupled to the interior surfaces of the tubular members;

wherein the coating of lubricant comprises:

about 1 to 90 percent solids by volume.

28. The expandable tubular assembly of claim 27, wherein the coating of lubricant comprises:

about 5 to 70 percent solids by volume.

29. The expandable tubular assembly of claim 28, wherein the coating of lubricant comprises:

about 15 to 50 percent solids by volume.

30. An expandable tubular assembly, comprising:

one or more tubular members; and a layer of a lubricant coupled to the interior surfaces of the tubular members;

wherein the coating of lubricant comprises:

about 5 to 80 percent graphite;

about 5 to 80 percent molybdenum disulfide;

about 1 to 40 percent PTFE; and about 1 to 40 percent silicone polymers.

31. An expandable tubular assembly, comprising:

one or more tubular members; and a layer of a lubricant coupled to the interior surfaces of the tubular members;

wherein the coating of lubricant comprises one or more of the following:

ester;

sulfurized oil;

alkanolamides;

amine;

amine salt;

olefin;

polyolefins;

C-8 to C-18 linear alcohol;

derivatives of C-8 to C-18 linear alcohol including ester;

derivatives of C-8 to C-18 linear alcohol including amine;

derivatives of C-8 to C-18 linear alcohol including carboxylate;

sulfonate;

polyethylene glycol;

silicone;

siloxane;

dinonyl phenol;

ethylene oxide block copolymer; and propylene oxide block copolymer.

32. The method of claim 1, wherein the tubular members comprise wellbore casings.

33. The method of claim 1, wherein the tubular members comprise underground pipes.

34. The method of claim 1, wherein the tubular members comprise structural supports.

35. The method of claim 1, wherein the coating of lubricant is chemically bonded to the interior surfaces of the tubular members.

36. The method of claim 1, wherein the coating of lubricant is mechanically bonded to the interior surfaces of the tubular members.

37. The method of claim 1, wherein the coating of lubricant is adhesively bonded to the interior surfaces of the tubular members.

38. The method of claim 1, wherein the coating of lubricant includes:

a primer coating coupled to the interior surfaces of the tubular members; and a coating of an antifriction paste coupled to the primer.

39. The method of claim 1, wherein the coating of lubricant includes, by weight:

40–80% epoxy resin, 15–30% molybdenum disulfide, 10–15% graphite, 5–10% aluminum, 5–10% copper, 8–15% alumisilicate, and 5–10% polyethylenepolyamine.

40. The method of claim 1, wherein the coating of lubricant comprises a metallic soap.

41. The method of claim 1, wherein the coating of lubricant comprises zinc phosphate.

42. The method of claim 1, wherein the coating of lubricant provides a coefficient of dynamic friction of between about 0.08 to 0.1.

43. The method of claim 1, wherein the coating of lubricant is selected from the group consisting of:

sodium stearates, calcium stearates, zinc stearates, zinc phosphate, manganese phosphate, C-Lube-10, C-Phos-58-M, C-Phos-58-R, polytetrafluoroethylene, molybdenum disulfide, and metallic soaps.

44. The method of claim 1, wherein the coating of lubricant provides a sliding coefficient of friction less than about 0.20.

45. The method of claim 1, wherein the coating of lubricant is selected from the group consisting of:

polyacrylamide polymers, AMPS-acrylamide copolymers, modified cellulose derivatives, hydroxyethylcellulose, carboxymethyl hydroxyethyl cellulose, polyvinyl alcohol polymers, polyvinyl acetate polymers, polyvinyl alcohol acetate copolymers, polyvinyl vinyl acetate copolymers, polyvinyl pyrrolidone and copolymers including polyolefins, latexes, styrene butadiene latex, urethane latexes, styrene-maleic annhydride copolymers, viscosity index improvers for motor oils, polyacrylate esters, block copolymers including styrene, block copolymers including isoprene butadiene, block copolymers including ethylene, and ethylene acrylic acid copolymers.

46. The method of claim 1, wherein the coating of lubricant is selected from the group consisting of:

graphite, molybdenum disulfide, lead powder, antimony oxide, poly tetrafluoroethylene, and silicone polymers.

47. The method of claim 1, wherein the coating of lubricant comprises:

a solid lubricant; and a binder.

48. The method of claim 47, wherein the binder is selected from the group consisting of:

epoxy, acrylic, urea-formaldehyde, melamine formaldehyde, furan based resin, acetone formaldehyde, phenolic, alkyd resins, and silicone modified alkyd resin.

49. The method of claim 47, wherein the binder is selected from the group consisting of:

vinyl acetate, vinyl chloride, maleic annhydride, maleic acid, ethylene-acrylic acid copolymers, ethylene-methacrylic acid copolymers, and ethylene-vinyl acetate copolymers.

50. The method of claim 1, wherein the coating of lubricant comprises a suspension of particles in a carrier solvent.

51. The method of claim 1, the coating of lubricant is selected from the group consisting of:

manganese phosphate, zinc phosphate, and iron phosphate.

52. The method of claim 1, wherein the coating of lubricant comprises:

about 1 to 90 percent solids by volume.

53. The method of claim 52, wherein the coating of lubricant comprises:

about 5 to 70 percent solids by volume.

54. The method of claim 53, wherein the coating of lubricant comprises:

about 15 to 50 percent solids by volume.

55. The method of claim 1, wherein the coating of lubricant comprises:

about 5 to 80 percent graphite;

about 5 to 80 percent molybdenum disulfide;

about 1 to 40 percent PTFE; and about 1 to 40 percent silicone polymers.

56. The method of claim 1, wherein the coating of lubricant comprises one or more of the following:

ester;

sulfurized oil;

alkanolamides;

amine;

amine salt;

olefin;

polyolefins;

C-8 to C-18 linear alcohol;

derivative of C-8 to C-18 linear alcohol including ester;

derivative of C-8 to C-18 linear alcohol including amine;

derivative of C-8 to C-18 linear alcohol including carboxylate;

sulfonate;

polyethylene glycol;

silicone;

siloxane;

dinonyl phenol;

ethylene oxide block copolymer; and propylene oxide block copolymer.

57. The apparatus of claim 2, wherein the tubular members comprise wellbore casings.

58. The apparatus of claim 2, wherein the tubular members comprise underground pipes.

59. The apparatus of claim 2, wherein the tubular members comprise structural supports.

60. The apparatus of claim 2, wherein the coating of lubricant is chemically bonded to the interior surfaces of the tubular members.

61. The apparatus of claim 2, wherein the coating of lubricant is mechanically bonded to the interior surfaces of the tubular members.

62. The apparatus of claim 2, wherein the coating of lubricant is adhesively bonded to the interior surfaces of the tubular members.

63. The apparatus of claim 2, wherein the coating of lubricant includes:

a primer coating coupled to the interior surfaces of the tubular members; and a coating of an antifriction paste coupled to the primer.

64. The apparatus of claim 2, wherein the coating of lubricant includes, by weight:

40–80% epoxy resin, 15–30% molybdenum disulfide, 10–15% graphite, 5–10% aluminum, 5–10% copper, 8–15% alumisilicate, and 5–10% polyethylenepolyamine.

65. The apparatus of claim 2, wherein the coating of lubricant comprises a metallic soap.

66. The apparatus of claim 2, wherein the coating of lubricant comprises zinc phosphate.

67. The apparatus of claim 2, wherein the coating of lubricant provides a coefficient of dynamic friction of between about 0.08 to 0.1.

68. The apparatus of claim 2, wherein the coating of lubricant is selected from the group consisting of:

sodium stearates, calcium stearates, zinc stearates, zinc phosphate, manganese phosphate, C-Lube-10, C-Phos-58-M, C-Phos-58-R, polytetrafluoroethylene, molybdenum disulfide, and metallic soaps.

69. The apparatus of claim 2, wherein the coating of lubricant provides a sliding coefficient of friction less than about 0.20.

70. The apparatus of claim 2, wherein the coating of lubricant is selected from the group consisting of:

polyacrylamide polymers, AMPS-acrylamide copolymers, modified cellulose derivatives, hydroxyethylcellulose, carboxymethyl hydroxyethyl cellulose, polyvinyl alcohol polymers, polyvinyl acetate polymers, polyvinyl alcohol acetate copolymers, polyvinyl vinyl acetate copolymers, polyvinyl pyrrolidone and copolymers including polyolefins, latexes, styrene butadiene latex, urethane latexes, styrene-maleic annhydride copolymers, viscosity index improvers for motor oils, polyacrylate esters, block copolymers including styrene, block copolymers including isoprene butadiene, block copolymers including ethylene, and ethylene acrylic acid copolymers.

71. The apparatus of claim 2, wherein the coating of lubricant is selected from the group consisting of:

graphite, molybdenum disulfide, lead powder, antimony oxide, poly tetrafluoroethylene, and silicone polymers.

72. The apparatus of claim 2, wherein the coating of lubricant comprises:

a solid lubricant; and a binder.

73. The apparatus of claim 72, wherein the binder is selected from the group consisting of:

epoxy, acrylic, urea-formaldehyde, melamine formaldehyde, furan based resin, acetone formaldehyde, phenolic, alkyd resins, and silicone modified alkyd resin.

74. The apparatus of claim 72, wherein the binder is selected from the group consisting of:

vinyl acetate, vinyl chloride, maleic annhydride, maleic acid, ethylene-acrylic acid copolymers, ethylene-methacrylic acid copolymers, and ethylene-vinyl acetate copolymers.

75. The apparatus of claim 2, wherein the coating of lubricant comprises a suspension of particles in a carrier solvent.

76. The apparatus of claim 2, the coating of lubricant is selected from the group consisting of:

manganese phosphate, zinc phosphate, and iron phosphate.

77. The apparatus of claim 2, wherein the coating of lubricant comprises:

about 1 to 90 percent solids by volume.

78. The apparatus of claim 77, wherein the coating of lubricant comprises:

about 5 to 70 percent solids by volume.

79. The apparatus of claim 78, wherein the coating of lubricant comprises:

about 15 to 50 percent solids by volume.

80. The apparatus of claim 2, wherein the coating of lubricant comprises:

about 5 to 80 percent graphite;

about 5 to 80 percent molybdenum disulfide;

about 1 to 40 percent PTFE; and about 1 to 40 percent silicone polymers.

81. The apparatus of claim 2, wherein the coating of lubricant comprises one or more of the following:

ester;

sulfurized oil;

alkanolamides;

amine;

amine salt;

olefin;

polyolefins;

C-8 to C-18 linear alcohol;

derivative of C-8 to C-18 linear alcohol including ester;

derivative of C-8 to C-18 linear alcohol including amine;

derivative of C-8 to C-18 linear alcohol including carboxylate;

sulfonate;

polyethylene glycol;

silicone;

siloxane;

dinonyl phenol;

ethylene oxide block copolymer; and propylene oxide block copolymer.

82. An expandable tubular assembly, comprising:

one or more tubular members; and a layer of a first part of a lubricant coupled to the interior surfaces of the tubular members;

wherein the tubular members comprise wellbore casings.

83. An expandable tubular assembly, comprising:

one or more tubular members; and a layer of a first part of a lubricant coupled to the interior surfaces of the tubular members;

wherein the tubular members comprise underground pipes.

84. An expandable tubular assembly, comprising:

one or more tubular members; and a layer of a first part of a lubricant coupled to the interior surfaces of the tubular members;

wherein the tubular members comprise structural supports.

85. An expandable tubular assembly, comprising:

one or more tubular members; and a layer of a first part of a lubricant coupled to the interior surfaces of the tubular members;

wherein the layer of the first part of the lubricant is chemically bonded to the interior surfaces of the tubular members.

86. An expandable tubular assembly, comprising:

one or more tubular members; and a layer of a first part of a lubricant coupled to the interior surfaces of the tubular members;

wherein the layer of the first part of the lubricant is mechanically bonded to the interior surfaces of the tubular members.

87. An expandable tubular assembly, comprising:

one or more tubular members; and a layer of a first part of a lubricant coupled to the interior surfaces of the tubular members;

wherein the layer of the first part of the lubricant is adhesively bonded to the interior surfaces of the tubular members.

88. An expandable tubular assembly, comprising:

one or more tubular members; and a layer of a first part of a lubricant coupled to the interior surfaces of the tubular members;

wherein the layer of the first part of the lubricant includes:

a primer coating coupled to the interior surfaces of the tubular members; and a coating of an antifriction paste coupled to the primer.

89. An expandable tubular assembly, comprising:

one or more tubular members; and a layer of a first part of a lubricant coupled to the interior surfaces of the tubular members;

wherein the layer of the first part of the lubricant includes, by weight:

40–80% epoxy resin, 15–30% molybdenum disulfide, 10–15% graphite, 5–10% aluminum, 5–10% copper, 8–15% alumisilicate, and 5–10% polyethylenepolyamine.

90. An expandable tubular assembly, comprising:

one or more tubular members; and a layer of a first part of a lubricant coupled to the interior surfaces of the tubular members;

wherein the layer of the first part of the lubricant comprises a metallic soap.

91. An expandable tubular assembly, comprising:

one or more tubular members; and a layer of a first part of a lubricant coupled to the interior surfaces of the tubular members;

wherein the layer of the first part of the lubricant comprises zinc phosphate.

92. An expandable tubular assembly, comprising:

one or more tubular members; and a layer of a first part of a lubricant coupled to the interior surfaces of the tubular members;

wherein the lubricant provides a coefficient of dynamic friction of between about 0.08 to 0.1.

93. An expandable tubular assembly, comprising:

one or more tubular members; and a layer of a first part of a lubricant coupled to the interior surfaces of the tubular members;

wherein the lubricant is selected from the group consisting of:

sodium stearates, calcium stearates, zinc stearates, zinc phosphate, manganese phosphate, C-Lube-10, C-Phos-58-M, C-Phos-58-R, polytetrafluoroethylene, molybdenum disulfide, and metallic soaps.

94. An expandable tubular assembly, comprising:

one or more tubular members; and a layer of a first part of a lubricant coupled to the interior surfaces of the tubular members;

wherein the lubricant provides a sliding coefficient of friction less than about 0.20.

95. An expandable tubular assembly, comprising:

one or more tubular members; and a layer of a first part of a lubricant coupled to the interior surfaces of the tubular members;

wherein the lubricant is selected from the group consisting of:

polyacrylamide polymers, AMPS-acrylamide copolymers, modified cellulose derivatives, hydroxyethylcellulose, carboxymethyl hydroxyethyl cellulose, polyvinyl alcohol polymers, polyvinyl acetate polymers, polyvinyl alcohol acetate copolymers, polyvinyl vinyl acetate copolymers, polyvinyl pyrrolidone and copolymers including polyolefins, latexes, styrene butadiene latex, urethane latexes, styrene-maleic annhydride copolymers, viscosity index improvers for motor oils, polyacrylate esters, block copolymers including styrene, block copolymers including isoprene butadiene, block copolymers including ethylene, and ethylene acrylic acid copolymers.

96. An expandable tubular assembly, comprising:

one or more tubular members; and a layer of a first part of a lubricant coupled to the interior surfaces of the tubular members;

wherein the lubricant is selected from the group consisting of:

graphite, molybdenum disulfide, lead powder, antimony oxide, poly tetrafluoroethylene, and silicone polymers.

97. An expandable tubular assembly, comprising:

one or more tubular members; and a layer of a first part of a lubricant coupled to the interior surfaces of the tubular members;

wherein the layer of the first part of the lubricant comprises:

a solid lubricant; and a binder.

98. The expandable tubular assembly of claim 97, wherein the binder is selected from the group consisting of:

epoxy, acrylic, urea-formaldehyde, melamine formaldehyde, furan based resin, acetone formaldehyde, phenolic, alkyd resins, and silicone modified alkyd resin.

99. The expandable tubular assembly of claim 97, wherein the binder is selected from the group consisting of:

vinyl acetate, vinyl chloride, maleic annhydride, maleic acid, ethylene-acrylic acid copolymers, ethylene-methacrylic acid copolymers, and ethylene-vinyl acetate copolymers.

100. An expandable tubular assembly, comprising:

one or more tubular members; and a layer of a first part of a lubricant coupled to the interior surfaces of the tubular members;

wherein the layer of the first part of the lubricant comprises a suspension of particles in a carrier solvent.

101. An expandable tubular assembly, comprising:

one or more tubular members; and a layer of a first part of a lubricant coupled to the interior surfaces of the tubular members;

wherein the layer of the first part of the lubricant is selected from the group consisting of:

manganese phosphate, zinc phosphate, and iron phosphate.

102. An expandable tubular assembly, comprising:

one or more tubular members; and a layer of a first part of a lubricant coupled to the interior surfaces of the tubular members;

wherein the layer of the first part of the lubricant comprises:

about 1 to 90 percent solids by volume.

103. The expandable tubular assembly of claim 102, wherein the layer of the first part of the lubricant comprises:

about 5 to 70 percent solids by volume.

104. The expandable tubular assembly of claim 103, wherein the layer of the first part of the lubricant comprises:

about 15 to 50 percent solids by volume.

105. An expandable tubular assembly, comprising:

one or more tubular members; and a layer of a first part of a lubricant coupled to the interior surfaces of the tubular members;

wherein the layer of the first part of the lubricant comprises:

about 5 to 80 percent graphite;

about 5 to 80 percent molybdenum disulfide;

about 1 to 40 percent PTFE; and about 1 to 40 percent silicone polymers.

106. An expandable tubular assembly, comprising:

one or more tubular members; and a layer of a first part of a lubricant coupled to the interior surfaces of the tubular members;

wherein the layer of the first part of the lubricant comprises one or more of the following:

ester;

sulfurized oil;

alkanolamides;

amine;

amine salt;

olefin;

polyolefins;

C-8 to C-18 linear alcohol;

derivatives of C-8 to C-18 linear alcohol including ester;

derivatives of C-8 to C-18 linear alcohol including amine;

derivatives of C-8 to C-18 linear alcohol including carboxylate;

sulfonate;

polyethylene glycol;

silicone;

siloxane;

dinonyl phenol;

ethylene oxide block copolymer; and propylene oxide block copolymer.

107. The method of claim 3, wherein the tubular members comprise wellbore casings.

108. The method of claim 3, wherein the tubular members comprise underground pipes.

109. The method of claim 3, wherein the tubular members comprise structural supports.

110. The method of claim 3, wherein the lubricant comprises a metallic soap.

111. The method of claim 3, wherein the lubricant comprises zinc phosphate.

112. The method of claim 3, wherein the lubricant provides a coefficient of dynamic friction of between about 0.08 to 0.1.

113. The method of claim 3, wherein the lubricant is selected from the group consisting of:

sodium stearates, calcium stearates, zinc stearates, zinc phosphate, manganese phosphate, C-Lube-10, C-Phos-58-M, C-Phos-58-R, polytetrafluoroethylene, molybdenum disulfide, and metallic soaps.

114. The method of claim 3, wherein the lubricant provides a sliding coefficient of friction less than about 0.20.

115. The method of claim 3, wherein the lubricant is selected from the group consisting of:

polyacrylamide polymers, AMPS-acrylamide copolymers, modified cellulose derivatives, hydroxyethylcellulose, carboxymethyl hydroxyethyl cellulose, polyvinyl alcohol polymers, polyvinyl acetate polymers, polyvinyl alcohol acetate copolymers, polyvinyl vinyl acetate copolymers, polyvinyl pyrrolidone and copolymers including polyolefins, latexes, styrene butadiene latex, urethane latexes, styrene-maleic annhydride copolymers, viscosity index improvers for motor oils, polyacrylate esters, block copolymers including styrene, block copolymers including isoprene butadiene, block copolymers including ethylene, and ethylene acrylic acid copolymers.

116. The method of claim 3, wherein the lubricant is selected from the group consisting of:

graphite, molybdenum disulfide, lead powder, antimony oxide, poly tetrafluoroethylene, and silicone polymers.

117. The method of claim 3, wherein the lubricant comprises a suspension of particles in a carrier solvent.

118. The method of claim 3, wherein the lubricant is selected from the group consisting of:

manganese phosphate, zinc phosphate, and iron phosphate.

119. The method of claim 3, wherein the lubricant comprises:

about 1 to 90 percent solids by volume.

120. The method of claim 119, wherein the lubricant comprises:

about 5 to 70 percent solids by volume.

121. The method of claim 120, wherein the lubricant comprises:

about 15 to 50 percent solids by volume.

122. The method of claim 3, wherein the lubricant comprises:

about 5 to 80 percent graphite;

about 5 to 80 percent molybdenum disulfide;

about 1 to 40 percent PTFE; and about 1 to 40 percent silicone polymers.

123. The method of claim 3, wherein the lubricant comprises one or more of the following:

ester;

sulfurized oil;

alkanolamides;

amine;

amine salt;

olefin;

polyolefins;

C-8 to C-18 linear alcohol;

derivative of C-8 to C-18 linear alcohol including ester;

derivative of C-8 to C-18 linear alcohol including amine;

derivative of C-8 to C-18 linear alcohol including carboxylate;

sulfonate;

polyethylene glycol;

silicone;

siloxane;

dinonyl phenol;

ethylene oxide block copolymer; and propylene oxide block copolymer.

124. The apparatus of claim 4, wherein the tubular members comprise wellbore casings.

125. The apparatus of claim 4, wherein the tubular members comprise underground pipes.

126. The apparatus of claim 4, wherein the tubular members comprise structural supports.

127. The apparatus of claim 4, wherein the lubricant comprises a metallic soap.

128. The apparatus of claim 4, wherein the lubricant comprises zinc phosphate.

129. The apparatus of claim 4, wherein the lubricant provides a coefficient of dynamic friction of between about 0.08 to 0.1.

130. The apparatus of claim 4, wherein the lubricant is selected from the group consisting of:

sodium stearates, calcium stearates, zinc stearates, zinc phosphate, manganese phosphate, C-Lube-10, C-Phos-58-M, C-Phos-58-R, polytetrafluoroethylene, molybdenum disulfide, and metallic soaps.

131. The apparatus of claim 4, wherein the lubricant provides a sliding coefficient of friction less than about 0.20.

132. The apparatus of claim 4, wherein the lubricant is selected from the group consisting of:

polyacrylamide polymers, AMPS-acrylamide copolymers, modified cellulose derivatives, hydroxyethylcellulose, carboxymethyl hydroxyethyl cellulose, polyvinyl alcohol polymers, polyvinyl acetate polymers, polyvinyl alcohol acetate copolymers, polyvinyl vinyl acetate copolymers, polyvinyl pyrrolidone and copolymers including polyolefins, latexes, styrene butadiene latex, urethane latexes, styrene-maleic annhydride copolymers, viscosity index improvers for motor oils, polyacrylate esters, block copolymers including styrene, block copolymers including isoprene butadiene, block copolymers including ethylene, and ethylene acrylic acid copolymers.

133. The apparatus of claim 4, wherein the lubricant is selected from the group consisting of:

graphite, molybdenum disulfide, lead powder, antimony oxide, poly tetrafluoroethylene, and silicone polymers.

134. The apparatus of claim 4, wherein the lubricant comprises a suspension of particles in a carrier solvent.

135. The apparatus of claim 4, wherein the lubricant is selected from the group consisting of:

manganese phosphate, zinc phosphate, and iron phosphate.

136. The apparatus of claim 4, wherein the lubricant comprises:

about 1 to 90 percent solids by volume.

137. The apparatus of claim 136, wherein the lubricant comprises:

about 5 to 70 percent solids by volume.

138. The apparatus of claim 137, wherein the lubricant comprises:

about 15 to 50 percent solids by volume.

139. The apparatus of claim 4, wherein the lubricant comprises:

about 5 to 80 percent graphite;

about 5 to 80 percent molybdenum disulfide;

about 1 to 40 percent PTFE; and about 1 to 40 percent silicone polymers.

140. The apparatus of claim 4, wherein the lubricant comprises one or more of the following:

ester;

sulfurized oil;

alkanolamides;

amine;

amine salt;

olefin;

polyolefins;

C-8 to C-18 linear alcohol;

derivative of C-8 to C-18 linear alcohol including ester;

derivative of C-8 to C-18 linear alcohol including amine;

derivative of C-8 to C-18 linear alcohol including carboxylate;

sulfonate;

polyethylene glycol;

silicone;

siloxane;

dinonyl phenol;

ethylene oxide block copolymer; and propylene oxide block copolymer.

141. The method of claim 5, wherein the tubular members comprise wellbore casings.

142. The method of claim 5, wherein the tubular members comprise underground pipes.

143. The method of claim 5, wherein the tubular members comprise structural supports.

144. The method of claim 5, wherein the lubricant comprises a metallic soap.

145. The method of claim 5, wherein the lubricant comprises zinc phosphate.

146. The method of claim 5, wherein the lubricant provides a coefficient of dynamic friction of between about 0.08 to 0.1.

147. The method of claim 5, wherein the lubricant is selected from the group consisting of:

sodium stearates, calcium stearates, zinc stearates, zinc phosphate, manganese phosphate, C-Lube-10, C-Phos-58-M, C-Phos-58-R, polytetrafluoroethylene, molybdenum disulfide, and metallic soaps.

148. The method of claim 5, wherein the lubricant provides a sliding coefficient of friction less than about 0.20.

149. The method of claim 5, wherein the lubricant is selected from the group consisting of:

polyacrylamide polymers, AMPS-acrylamide copolymers, modified cellulose derivatives, hydroxyethylcellulose, carboxymethyl hydroxyethyl cellulose, polyvinyl alcohol polymers, polyvinyl acetate polymers, polyvinyl alcohol acetate copolymers, polyvinyl vinyl acetate copolymers, polyvinyl pyrrolidone and copolymers including polyolefins, latexes, styrene butadiene latex, urethane latexes, styrene-maleic annhydride copolymers, viscosity index improvers for motor oils, polyacrylate esters, block copolymers including styrene, block copolymers including isoprene butadiene, block copolymers including ethylene, and ethylene acrylic acid copolymers.

150. The method of claim 5, wherein the lubricant is selected from the group consisting of:

graphite, molybdenum disulfide, lead powder, antimony oxide, poly tetrafluoroethylene, and silicone polymers.

151. The method of claim 5, wherein the lubricant comprises a suspension of particles in a carrier solvent.

152. The method of claim 5, wherein the lubricant is selected from the group consisting of:

manganese phosphate, zinc phosphate, and iron phosphate.

153. The method of claim 5, wherein the lubricant comprises:

about 1 to 90 percent solids by volume.

154. The method of claim 153, wherein the lubricant comprises:

about 5 to 70 percent solids by volume.

155. The method of claim 154, wherein the lubricant comprises:

about 15 to 50 percent solids by volume.

156. The method of claim 5, wherein the lubricant comprises:

about 5 to 80 percent graphite;

about 5 to 80 percent molybdenum disulfide;

about 1 to 40 percent PTFE; and about 1 to 40 percent silicone polymers.

157. The method of claim 5, wherein the lubricant comprises one or more of the following:

ester;

sulfurized oil;

alkanolamides;

amine;

amine salt;

olefin;

polyolefins;

C-8 to C-18 linear alcohol;

derivative of C-8 to C-18 linear alcohol including ester;

derivative of C-8 to C-18 linear alcohol including amine;

derivative of C-8 to C-18 linear alcohol including carboxylate;

sulfonate;

polyethylene glycol;

silicone;

siloxane;

dinonyl phenol;

ethylene oxide block copolymer; and propylene oxide block copolymer.

158. The apparatus of claim 6, wherein the tubular members comprise wellbore casings.

159. The apparatus of claim 6, wherein the tubular members comprise underground pipes.

160. The apparatus of claim 6, wherein the tubular members comprise structural supports.

161. The apparatus of claim 6, wherein the lubricant comprises a metallic soap.

162. The apparatus of claim 6, wherein the lubricant comprises zinc phosphate.

163. The apparatus of claim 6, wherein the lubricant provides a coefficient of dynamic friction of between about 0.08 to 0.1.

164. The apparatus of claim 6, wherein the lubricant is selected from the group consisting of:

sodium stearates, calcium stearates, zinc stearates, zinc phosphate, manganese phosphate, C-Lube-10, C-Phos-58-M, C-Phos-58-R, polytetrafluoroethylene, molybdenum disulfide, and metallic soaps.

165. The apparatus of claim 6, wherein the lubricant provides a sliding coefficient of friction less than about 0.20.

166. The apparatus of claim 6, wherein the lubricant is selected from the group consisting of:

polyacrylamide polymers, AMPS-acrylamide copolymers, modified cellulose derivatives, hydroxyethylcellulose, carboxymethyl hydroxyethyl cellulose, polyvinyl alcohol polymers, polyvinyl acetate polymers, polyvinyl alcohol acetate copolymers, polyvinyl vinyl acetate copolymers, polyvinyl pyrrolidone and copolymers including polyolefins, latexes, styrene butadiene latex, urethane latexes, styrene-maleic annhydride copolymers, viscosity index improvers for motor oils, polyacrylate esters, block copolymers including styrene, block copolymers including isoprene butadiene, block copolymers including ethylene, and ethylene acrylic acid copolymers.

167. The apparatus of claim 6, wherein the lubricant is selected from the group consisting of:

graphite, molybdenum disulfide, lead powder, antimony oxide, poly tetrafluoroethylene, and silicone polymers.

168. The apparatus of claim 6, wherein the lubricant comprises a suspension of particles in a carrier solvent.

169. The apparatus of claim 6, wherein the lubricant is selected from the group consisting of:

manganese phosphate, zinc phosphate, and iron phosphate.

170. The apparatus of claim 6, wherein the lubricant comprises:

about 1 to 90 percent solids by volume.

171. The apparatus of claim 170, wherein the lubricant comprises:

about 5 to 70 percent solids by volume.

172. The apparatus of claim 171, wherein the lubricant comprises:

about 15 to 50 percent solids by volume.

173. The apparatus of claim 6, wherein the lubricant comprises:

about 5 to 80 percent graphite;

about 5 to 80 percent molybdenum disulfide;

about 1 to 40 percent PTFE; and about 1 to 40 percent silicone polymers.

174. The apparatus of claim 6, wherein the lubricant comprises one or more of the following:

ester;

sulfurized oil;

alkanolamides;

amine;

amine salt;

olefin;

polyolefins;

C-8 to C-18 linear alcohol;

derivative of C-8 to C-18 linear alcohol including ester;

derivative of C-8 to C-18 linear alcohol including amine;

derivative of C-8 to C-18 linear alcohol including carboxylate;

sulfonate;

polyethylene glycol;

silicone;

siloxane;

dinonyl phenol;

ethylene oxide block copolymer; and propylene oxide block copolymer.

* * * * *